US007012375B2

(12) United States Patent
Brock

(10) Patent No.: US 7,012,375 B2
(45) Date of Patent: Mar. 14, 2006

(54) THALLIUM-FREE METAL HALIDE FILL FOR DISCHARGE LAMPS AND DISCHARGE LAMP CONTAINING SAME

(75) Inventor: Lori R. Brock, Ipswich, MA (US)

(73) Assignee: Osram Sylvania Inc., Danvers, MA (US)

( * ) Notice: Subject to any disclaimer, the term of this patent is extended or adjusted under 35 U.S.C. 154(b) by 178 days.

(21) Appl. No.: 10/807,011

(22) Filed: Mar. 23, 2004

(65) Prior Publication Data

US 2005/0212436 A1 Sep. 29, 2005

(51) Int. Cl.
*H01J 17/20* (2006.01)

(52) U.S. Cl. ..... 313/640; 313/637

(58) Field of Classification Search ..... 313/637–643
See application file for complete search history.

(56) References Cited

U.S. PATENT DOCUMENTS

| | | | | |
|---|---|---|---|---|
| 5,424,609 | A | 6/1995 | Geven et al. | 313/623 |
| 6,404,129 | B1 | 6/2002 | Hendricx et al. | 313/620 |
| 6,501,220 | B1 | 12/2002 | Lambrechts et al. | 313/571 |
| 6,525,476 | B1 | 2/2003 | Geijtenbeck et al. | 313/640 |
| 6,620,272 | B1 | 9/2003 | Zaslavsky et al. | 156/73.5 |
| 6,717,364 | B1 | 4/2004 | Zhu et al. | 313/642 |

*Primary Examiner*—Vip Patel
(74) *Attorney, Agent, or Firm*—Robert F. Clark

(57) ABSTRACT

A thallium-free metal halide fill for ceramic metal halide lamps is provided wherein the fill comprises mercury, sodium iodide, an alkaline earth iodide selected from calcium iodide, strontium iodide, barium iodide, or combinations thereof, and a rare-earth iodide selected from cerium iodide, dysprosium iodide, holmium iodide, thulium iodide, or combinations thereof. In a preferred embodiment, the fill allows dimming of discharge lamps containing same to about 60% of rated power without substantially affecting the color of the emitted light.

18 Claims, 4 Drawing Sheets

THALLIUM-FREE METAL HALIDE FILL FOR DISCHARGE LAMPS AND DISCHARGE LAMP CONTAINING SAME

TECHNICAL FIELD

This invention relates generally to metal halide fill chemistries for discharge lamps. More particularly, this invention relates to thallium-free metal halide fills for discharge lamps.

BACKGROUND OF THE INVENTION

Metal halide discharge lamps are favored for their high efficacies and high color rendering properties which result from the complex emission spectra generated by their rare-earth chemistries. Particularly desirable are low-wattage ceramic metal halide lamps which offer improved color rendering, color temperature, and efficacy over traditional quartz arc tube types. This is because ceramic arc tubes can operate at higher temperatures than their quartz counterparts and are less prone to react with the various metal halide chemistries. Like most metal halide lamps, ceramic lamps are typically designed to emit white light. This requires that the x,y color coordinates of the target emission lay on or near the blackbody radiator curve. Not only must the fill chemistry of the lamp be adjusted to achieve the targeted emission, but this must also be done while maintaining a high color rendering index (CRI) and high efficacy (lumens/watt, LPW).

Most commercial ceramic metal halide lamps contain a complex combination of metal halides, particularly iodides. In general, iodides are more favored than fluorides because of their lower reactivity and are more favored than chlorides or bromides because they tend to be less stable at higher temperatures. Thallium iodide is a common component which is mainly used to adjust the (x,y) color coordinates so that they lay on the blackbody curve. For example, a commercial 4200 K lamp may contain mercury plus a mixture of TlI, NaI, $DyI_3$, $HoI_3$, $TmI_3$, and $CaI_2$. While lamps that contain thallium operate well at their rated power, their photometric characteristics deteriorate when the lamps are dimmed. This is primarily because the vapor pressure of thallium iodide is much higher than the vapor pressures of the other fill components. As the lamp power is reduced, the operating temperature of the arc tube is lowered and the 535 nm thallium atomic emission line begins to dominate the emission spectrum of the lamp. The disproportionate increase in the thallium emission causes the lamps to attain higher color temperatures and shifts the x,y color coordinates significantly above the blackbody curve. As a result, the dimmed lamps acquire an undesirable greenish hue. Experiments have shown that the higher the percentage of thallium in the fill, the greater the green shift.

Another problem with thallium-containing fills is that small temperature variations (±50° C.) lead to large variations in the correlated color temperature (CCT). This is problematic because the fill chemistry must be re-optimized each time a new outer jacket or reflector is added even though the arc tube and desired color coordinates are identical. Thallium iodide also has been associated with a low power factor (PF) and higher re-ignition (RI) peaks in some metal halide lamps. A low power factor means a less efficient lamp-ballast system and large RI peaks can cause excessive wall blackening. And lastly, thallium has been prohibited from use in U.S. household products since 1975.

SUMMARY OF THE INVENTION

It is an object of this invention to obviate the disadvantages of the prior art.

It is another object of this invention to provide a metal halide fill which does not contain thallium.

It is a further object of the invention to provide a thallium-free metal halide fill which can meet the requirements for commercially desirable lamps, particularly when dimmed to less than their rated power.

In one aspect, the thallium-free metal halide fill of this invention is comprised of mercury, sodium iodide, an alkaline earth iodide selected from calcium iodide, strontium iodide, barium iodide, or combinations thereof, and a rare-earth iodide selected from cerium iodide, dysprosium iodide, holmium iodide, thulium iodide, or combinations thereof;

wherein the molar ratio of sodium iodide to alkaline-earth iodide is from about 0.6 to about 11, the molar ratio of sodium iodide to rare-earth iodide is from about 0.5 to about 2.8, and the molar ratio of alkaline-earth iodide to rare-earth iodide is from about 0.1 to about 2.

In another aspect, the thallium-free metal halide fill of this invention comprises mercury and a mixture of metal halide salts, the mixture containing about 25 to about 55 mole percent sodium iodide, about 20 to about 50 mole percent of a rare-earth iodide selected from cerium iodide, dysprosium iodide, holmium iodide, thulium iodide, or combinations thereof, and about 5 to about 40 mole percent of an alkaline-earth iodide selected from calcium iodide, strontium iodide, barium iodide, or combinations thereof.

In yet another aspect of this invention, the thallium-free metal halide fill further contains lithium iodide in an amount up to about 30 mole percent of the total iodide content.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 3:
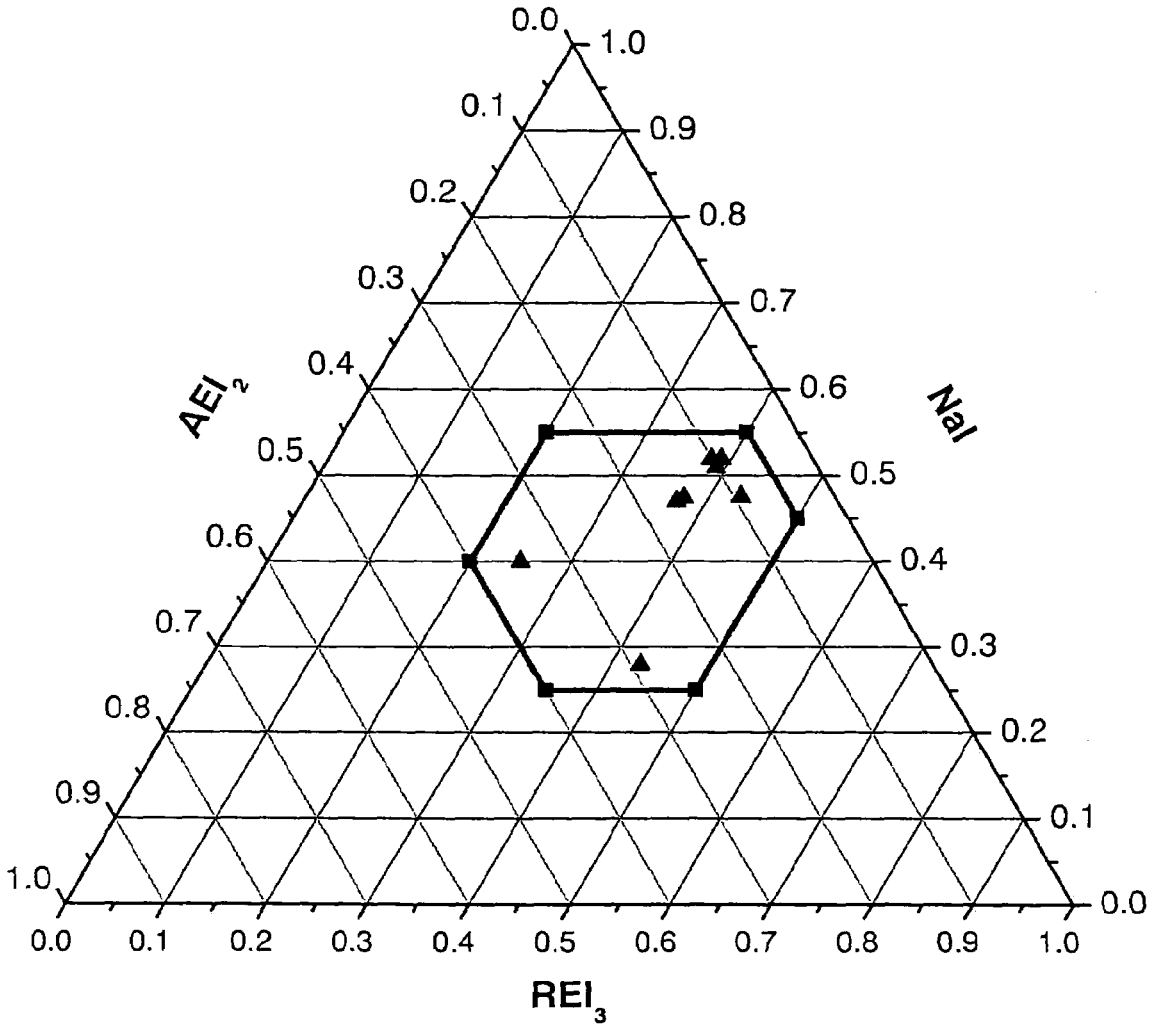
FIG. 3 is a ternary graph of the relative mole fractions of sodium iodide, alkaline-earth iodides ($AEI_2$), and rare-earth iodides ($REI_3$) of several examples of the thallium-free metal halide fill of this invention.

The thallium-free metal halide fill of this invention contains, in general, mercury and a mixture of metal halide salts comprised of (1) sodium iodide (NaI), (2) an alkaline-earth iodide ($AEI_2$) selected from calcium iodide, strontium iodide, barium iodide, or combinations thereof, and (3) a rare-earth iodide ($REI_3$) selected from thulium iodide, dysprosium iodide, holmium iodide, cerium iodide, or combinations thereof. The relative proportions of the metal halide salts in the mixture are designed to yield commercially desirable lamp characteristics, e.g., color temperature, CRI, high efficacy. Preferably, the correlated color temperature (CCT) is within the range from about 4000 K to about 5000 K, the CRI is greater than about 80, and the efficacy is greater than about 80 LPW. In one embodiment, the molar ratio of sodium iodide to alkaline-earth iodide is from about 0.6 to about 11, the molar ratio of sodium iodide to rare-earth iodide is from about 0.5 to about 2.8, and the molar ratio of alkaline-earth iodide to rare-earth iodide is from about 0.1 to about 2. In a more preferred embodiment, the mixture of metal halide salts comprises about 25 to about 55 mole percent sodium iodide, about 5 to about 40 mole percent alkaline-earth iodide, and about 20 to about 50 mole percent rare-earth iodide. This may be represented by the region encompassed by the polygon shown in FIG. 3 which is a ternary graph of the relative mole fractions of NaI, $AEI_2$, and $REI_3$ in the metal halide salt mixture. The fill may also contain lithium iodide in an amount up to about 30 mole percent of the total metal iodide content.

Figure 1:
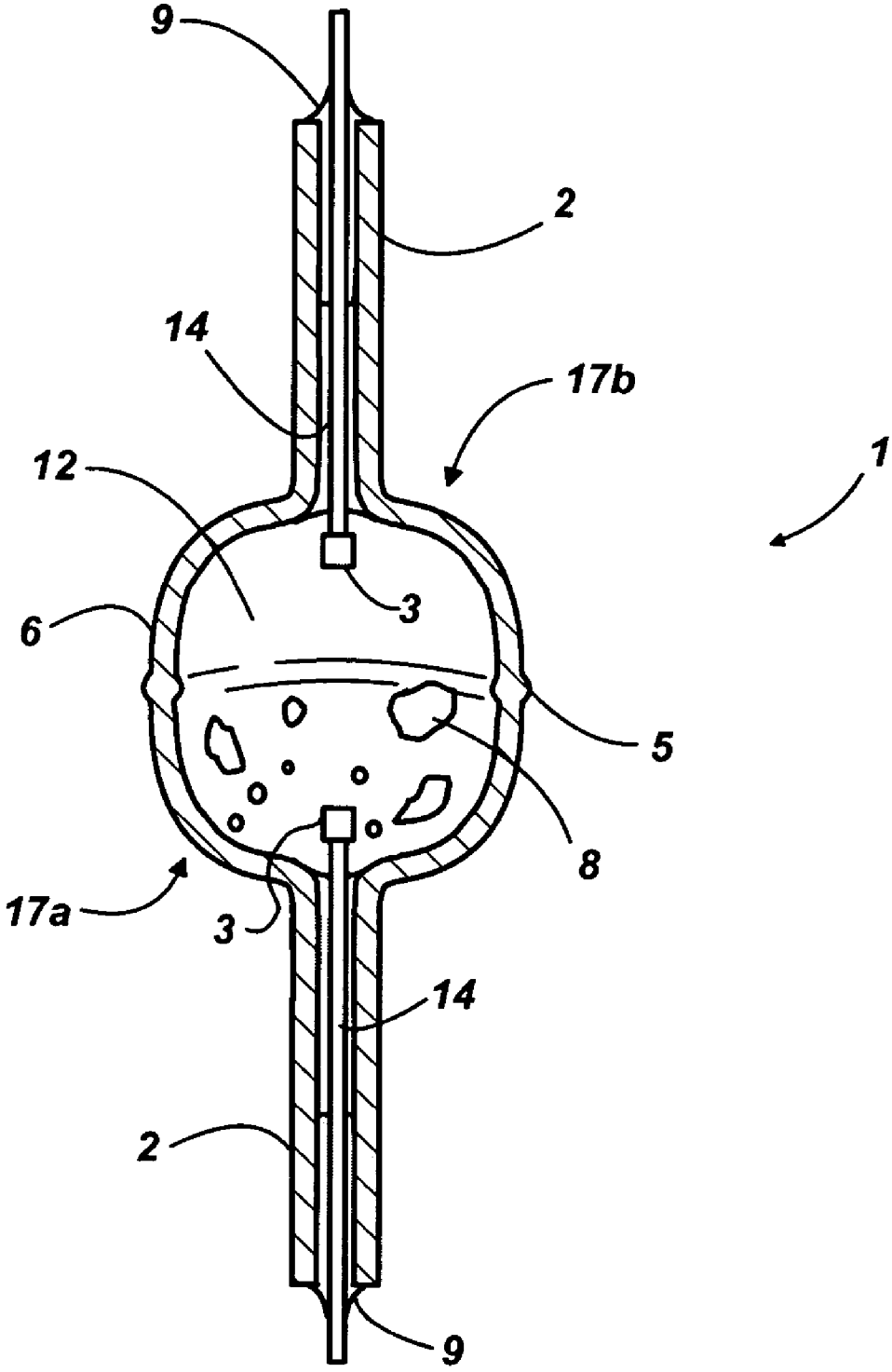
FIG. 1 is a cross-sectional illustration of a ceramic metal halide arc tube.

FIG. 1 is a cross-sectional illustration of a ceramic metal halide arc tube. The arc tube 1 is a two-piece design which is made by joining two identically molded ceramic halves in their green state and then subjecting the green piece to a high temperature sintering. The method of making the arc tube typically leaves a cosmetic seam 5 in the center of the arc tube where the two halves were mated. A more detailed description of a method of making this type of ceramic arc tube is described in U.S. Pat. No. 6,620,272 which is incorporated herein by reference. The arc tube is usually composed of translucent polycrystalline alumina, although other ceramic materials may be used.

The arc tube has hemispherical end wells 17*a*, 17*b* and is commonly referred to as a bulgy shape. The bulgy shape is preferred because it provides a more uniform temperature distribution compared to right-cylinder shapes such as those described in U.S. Pat. Nos. 5,424,609 and 6,525,476. The bulgy-shaped arc tube has an axially symmetric body 6 which encloses a discharge chamber 12. Two opposed capillary tubes 2 extend outwardly from the body 6 along a central axis. In this 2-piece design, the capillary tubes have been integrally molded with the arc tube body. The discharge chamber 12 of the arc tube contains a buffer gas, e.g., 30 to 300 torr Xe or Ar, and a thallium-free metal halide fill 8 as described herein.

Electrode assemblies 14 are inserted into each capillary tube 2. One end of the electrode assemblies 14 protrudes out of the arc tube to provide an electrical connection. The tips of the electrode assemblies which extend into the discharge chamber are fitted with a tungsten coil 3 or other similar means for providing a point of attachment for the arc discharge. The electrode assemblies are sealed hermetically to the capillary tubes by a frit material 9 (preferably, a $Al_2O_3$—$SiO_2$—$Dy_2O_3$ frit). During lamp operation, the electrode assemblies act to conduct an electrical current from an external source of electrical power to the interior of the arc tube in order to form an electrical arc in the discharge chamber.

Figure 2:
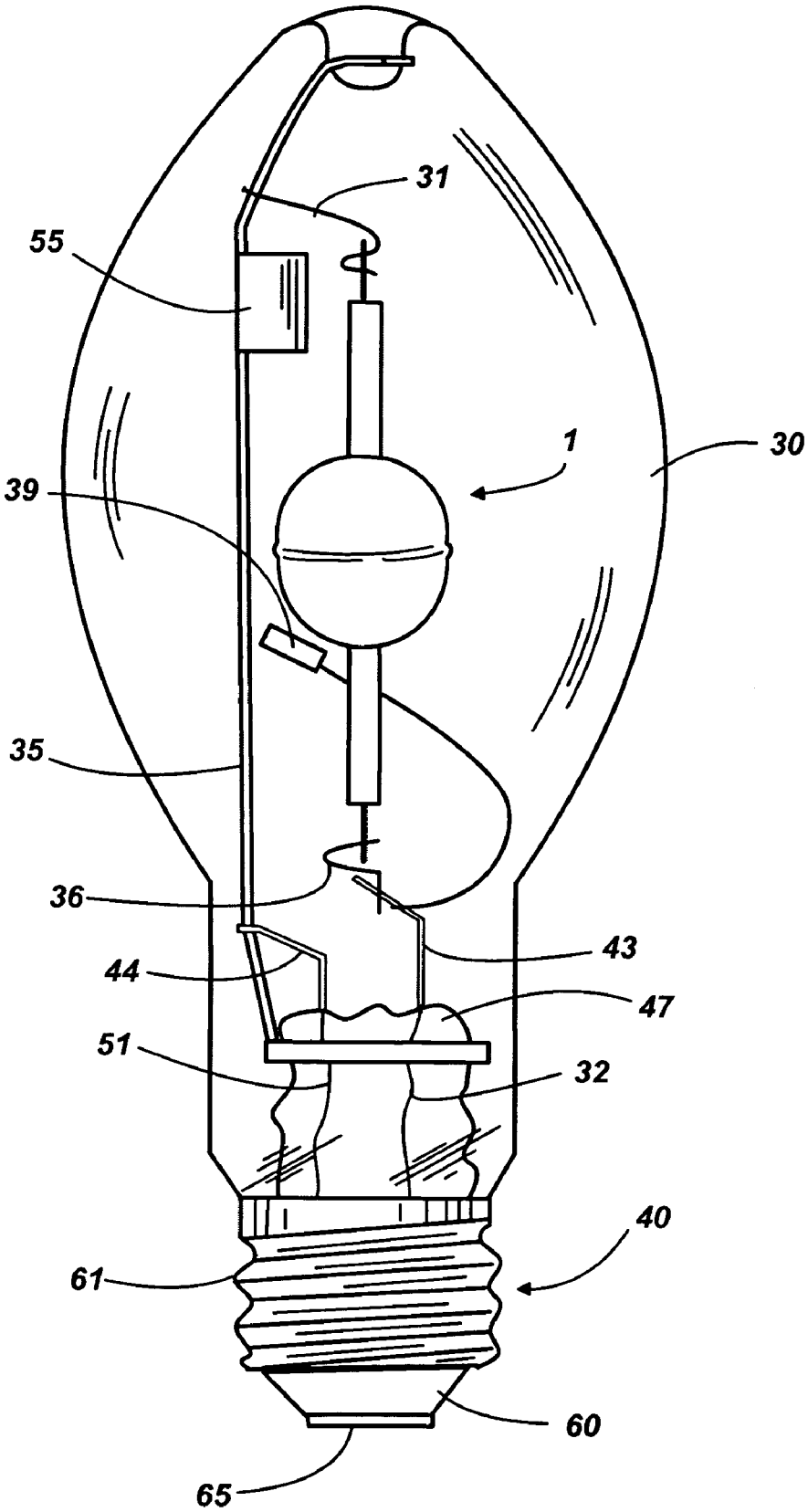
FIG. 2 is an illustration of a ceramic metal halide lamp.

FIG. 2 is an illustration of a ceramic metal halide lamp. The arc tube 1 is connected at one end to leadwire 31 which is attached to frame 35 and at the other end to leadwire 36 which is attached to mounting post 43. Electric power is supplied to the lamp through screw base 40. The threaded portion 61 of screw base 40 is electrically connected to frame 35 through leadwire 51 which is connected to a second mounting post 44. Base contact 65 of screw base 40 is electrically isolated from the threaded portion 61 by insulator 60. Leadwire 32 provides an electrical connection between the base contact 65 and the mounting post 43. A UV-generating starting aid 39 is connected to mounting post 43. Leadwires 51 and 32 pass through and are sealed within glass stem 47. A glass outer envelope 30 surrounds the arc tube and its associated components and is sealed to stem 47 to provide a gas-tight environment. Typically, the outer envelope is evacuated, although in some cases it may contain up to 400 torr of nitrogen gas. A getter strip 55 is used to reduce contamination of the envelope environment.

EXAMPLES

Several 70-watt ceramic metal halide test lamps were made with bulgy-shaped ceramic arc tubes. The composition of each arc tube fill is given below and the lamp photometry results are provided in Table 1. The points representing the relative mole fractions of NaI, $AEI_2$, and $REI_3$ in the arc tube fills of Examples 2–9 are plotted in FIG. 3.

Example 1 (control)

Arc tube fill (thallium-containing):

4.5 mg Hg, 9 mg metal halide mixture (23:38:12:9:9:9 molar ratio of NaI:$CaI_2$:TlI:$DyI_3$:$HoI_3$:$TmI_3$) and 260 torr argon.

NaI:$AEI_2$ molar ratio=0.60;
NaI:$REI_3$ molar ratio=0.85;
$AEI_2$:$REI_3$ molar ratio=1.4;
NaI:TlI molar ratio=1.92.

Example 2

Arc tube fill:

4 mg Hg, 8.6 mg metal halide mixture (47:16:37 molar ratio of NaI:$CaI_2$:$DyI_3$) and 260 torr Ar.

NaI:$AEI_2$ molar ratio=2.94;
NaI:$REI_3$ molar ratio=1.27;
$AEI_2$:$REI_3$ molar ratio=0.43.

Example 3

Arc Tube Fill:

4 mg Hg, 9.1 mg metal halide mixture (47.5:15:37.5 molar ratio of NaI:$BaI_2$:$DyI_3$) and 260 torr Ar.

NaI:$AEI_2$ molar ratio=3.17;
NaI:$REI_3$ molar ratio=1.27;
$AEI_2$:$REI_3$ molar ratio=0.40.

Example 4

Arc tube fill:

4.5 mg Hg, 8.3 mg metal halide mixture (39:8:23:30 molar ratio of NaI:$BaI_2$:LiI:$TmI_3$) and 260 torr Ar.

NaI:$AEI_2$ molar ratio=4.88;
NaI:$REI_3$ molar ratio=1.3;
$AEI_2$:$REI_3$ molar ratio=0.27.

Example 5

Arc tube fill:

4.0 mg Hg, 8.5 mg metal halide mixture (28:29:43 molar ratio of NaI:$CaI_2$:$TmI_3$) and 260 torr Ar.

NaI:$AEI_2$ molar ratio=0.97;
NaI:$REI_3$ molar ratio=0.65;
$AEI_2$:$REI_3$ molar ratio=0.67.

Example 6

Arc tube fill:

4 mg Hg, 9.3 mg metal halide mixture (39.7:22.9:7.8:29.6 molar ratio of NaI:LiI:$BaI_2$:$TmI_3$) and 260 torr Ar.

NaI:$AEI_2$ molar ratio=5.1;
NaI:$REI_3$ molar ratio=1.3;
$AEI_2$:$REI_3$ molar ratio=0.26.

Example 7

Arc tube fill:

4 mg Hg, 9.1 mg metal halide mixture (52:9:39 molar ratio of $NaI:BaI_2:TmI_3$) and 260 torr Ar.

$NaI:AEI_2$ molar ratio=5.8;

$NaI:REI_3$ molar ratio=1.3;

$AEI_2:REI_3$ molar ratio=0.23.

Example 8

Arc tube fill:

4 mg Hg, 9.0 mg metal halide mixture (40.4:16.1:18.5:25.1 molar ratio of $NaI:BaI_2:SrI_2:TmI_3$) and 260 torr Ar.

$NaI:AEI_2$ molar ratio=1.2;

$NaI:REI_3$ molar ratio=1.6;

$AEI_2:REI_3$ molar ratio=1.4.

Example 9

Arc tube fill:

4.15 mg Hg, 9.2 mg metal halide mixture (47.6:9.3:36.0:7.1 molar ratio of $NaI:BaI_2:TmI_3:CeI_3$) and 260 torr Ar.

$NaI:AEI_2$ molar ratio=5.1;

$NaI:REI_3$ molar ratio=1.1;

$AEI_2:REI_3$ molar ratio=0.22.

TABLE 1

Photometry Results

| | Watts | Volts | Amps | x | y | CCT | CRI | Lumens | LPW |
|---|---|---|---|---|---|---|---|---|---|
| Example 1 (control) | 70 | 82.9 | 1.03 | 0.3830 | 0.3912 | 4034 | 91 | 6226 | 89 |
| Example 2 | 70 | 83.3 | 1.03 | 0.3528 | 0.3241 | 4541 | 90 | 6235 | 89 |
| Example 3 | 70 | 82.0 | 1.05 | 0.3518 | 0.3296 | 4623 | 90 | 6214 | 88 |
| Example 4 | 70 | 91.4 | 0.93 | 0.368 | 0.362 | 4253 | 87 | 6379 | 91 |
| Example 5 | 71 | 77.4 | 1.08 | 0.3658 | 0.3571 | 4295 | 92 | 6959 | 98 |
| Example 6 | 70 | 76.5 | 1.09 | 0.3668 | 0.3568 | 4257 | 89 | 5936 | 85 |
| Example 7 | 70 | 94.6 | 0.92 | 0.3698 | 0.3679 | 4241 | 87 | 6955 | 99 |
| Example 8 | 72 | 81.3 | 1.06 | 0.3770 | 0.3700 | 4045 | 85 | 6144 | 85 |
| Example 9 | 70 | 83.4 | 1.02 | 0.3548 | 0.3698 | 4728 | 85 | 6964 | 100 |

Figure 4:
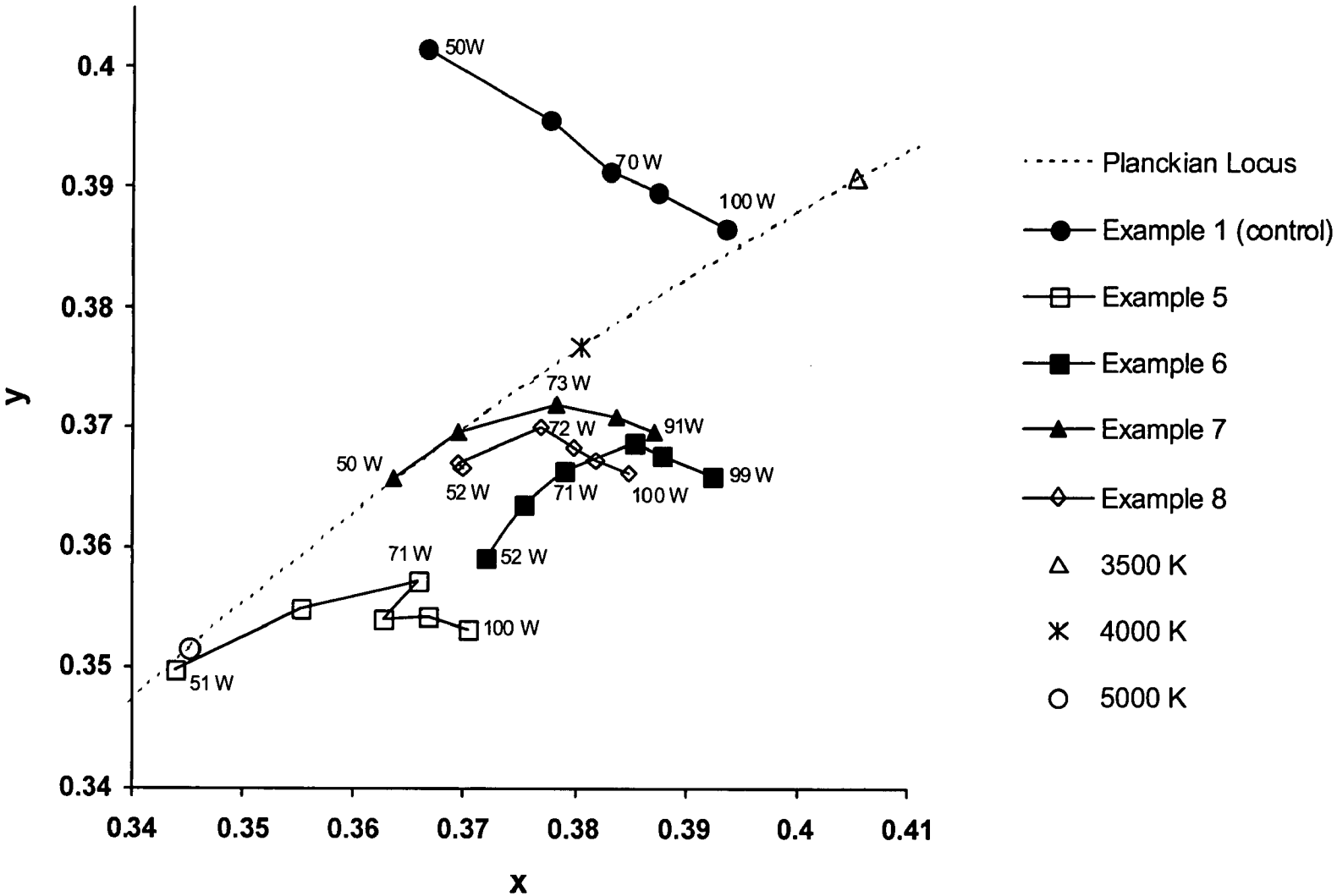
FIG. 4 is a chromaticity diagram that demonstrates the effect of dimming on the color coordinates of various ceramic metal halide lamps.

At rated lamp power, the thallium-free lamps of this invention exhibit photometric characteristics (CCT, CRI, efficacy, and x,y color coordinates) which are similar to their thallium-containing counterparts. However, unlike their thallium-containing counterparts, the thallium-free lamps continue to exhibit desirable photometric characteristics when dimmed to less than their rated power. This behavior can be seen in the chromaticity diagram shown in FIG. 4. The color coordinates of several lamps from Table 1 were measured as lamp power was varied from about 110 watts to about 40 watts (from about 160% to about 60% of rated power). The points, shown in FIG. 4 for each dimming curve, represent approximately 10 watt intervals of lamp power, from 50 to 100 watts. The dimming curves for the thallium-free lamps (Examples 5–8) are located slightly below the black-body radiator curve (Planckian locus) meaning that the white light emitted by the lamps has a desirable, slightly pinkish tint. The dimming curve for the thallium-containing lamp (Example 1) is located above the black-body curve meaning that the emitted white light has a greenish tint. More importantly, the portion of the dimming curves for the thallium-free lamps that corresponds to power values that are less than the lamps' rated power of 70 W run generally parallel to the black-body curve (Planckian Locus). This means that as the thallium-free lamps are dimmed from their rated power any changes in the color of the emitted light are only minimally perceptive. The corresponding region of the dimming curve for the thallium-containing lamp however runs in a direction which is generally normal to the black-body curve towards increasing y values. This means that as the thallium-containing lamp is dimmed the emitted light becomes perceptively more and more green which is highly undesirable.

While there has been shown and described what are at the present considered the preferred embodiments of the invention, it will be obvious to those skilled in the art that various changes and modifications may be made therein without departing from the scope of the invention as defined by the appended claims.

I claim:

1. A thallium-free metal halide fill for a discharge lamp, the fill comprising:

mercury, sodium iodide, an alkaline earth iodide selected from calcium iodide, strontium iodide, barium iodide, or combinations thereof, and a rare-earth iodide selected from cerium iodide, dysprosium iodide, holmium iodide, thulium iodide, or combinations thereof;

wherein the molar ratio of sodium iodide to alkaline-earth iodide is from about 0.6 to about 11, the molar ratio of sodium iodide to rare-earth iodide is from about 0.5 to about 2.8, and the molar ratio of alkaline-earth iodide to rare-earth iodide is from about 0.1 to about 2.

2. The thallium-free metal halide fill of claim 1 wherein the fill further contains lithium iodide in an amount up to about 30 mole percent of the total metal iodide content.

3. A thallium-free metal halide fill for a discharge lamp, the fill comprising: mercury and a mixture of metal halide salts, the mixture containing about 25 to about 55 mole percent sodium iodide, about 20 to about 50 mole percent of a rare-earth iodide selected from cerium iodide, dysprosium iodide, holmium iodide, thulium iodide, or combinations thereof, and about 5 to about 40 mole percent of an alkaline-earth iodide selected from calcium iodide, strontium iodide, barium iodide, or combinations thereof.

4. The thallium-free metal halide fill of claim 3 wherein the fill further contains lithium iodide in an amount up to about 30 mole percent of the total iodide content.

5. A discharge lamp for emitting white light comprising:

a base and an outer jacket enclosing a ceramic discharge vessel, the ceramic discharge vessel enclosing a discharge chamber containing a thallium-free metal halide fill, the discharge vessel having at least one hermetically sealed electrode assembly which extends into the discharge chamber and has an electrical connection to the base in order to generate an arc discharge within the discharge chamber;

the thallium-free metal halide fill comprising mercury, and a mixture of metal halide salts, the mixture containing sodium iodide, an alkaline earth iodide selected from calcium iodide, strontium iodide, barium iodide, or combinations thereof, and a rare-earth iodide selected from cerium iodide, dysprosium iodide, holmium iodide, thulium iodide, or combinations thereof; and when in operation, the x,y color coordinates of the emitted light when plotted on a chromaticity diagram move in a direction generally parallel to the Planckian locus as the lamp is dimmed below its rated power.

6. The discharge lamp of claim 5 wherein the molar ratio of sodium iodide to alkaline-earth iodide is from about 0.6 to about 11, the molar ratio of sodium iodide to rare-earth iodide is from about 0.5 to about 2.8, and the molar ratio of alkaline-earth iodide to rare-earth iodide is from about 0.1 to about 2.

7. The discharge lamp of claim 6 wherein the discharge vessel contains argon gas at a pressure from 30 torr to 300 torr.

8. The discharge lamp of claim 5 wherein the lamp has a rated power of 70 watts.

9. The discharge lamp of claim 5 wherein the mixture contains about 25 to about 55 mole percent sodium iodide, about 20 to about 50 mole percent of a rare-earth iodide selected from cerium iodide, dysprosium iodide, holmium iodide, thulium iodide, or combinations thereof, and about 5 to about 40 mole percent of an alkaline-earth iodide selected from calcium iodide, strontium iodide, barium iodide, or combinations thereof.

10. The discharge lamp of claim 6 wherein the fill further contains lithium iodide in an amount up to about 30 mole percent of the total metal iodide content.

11. The discharge lamp of claim 9 wherein the fill further contains lithium iodide in an amount up to about 30 mole percent of the total metal iodide content.

12. The discharge lamp of claim 9 wherein the discharge vessel contains argon gas at a pressure from 30 torr to 300 torr.

13. The discharge lamp of claim 9 wherein the lamp is dimmed to about 60% of its rated power.

14. A discharge lamp for emitting white light comprising: a base and an outer jacket enclosing a ceramic discharge vessel, the ceramic discharge vessel enclosing a discharge chamber containing a thallium-free metal halide fill, the discharge vessel having at least one hermetically sealed electrode assembly which extends into the discharge chamber and has an electrical connection to the base in order to generate an arc discharge within the discharge chamber;

the thallium-free metal halide fill comprising:

mercury, sodium iodide, an alkaline earth iodide selected from calcium iodide, strontium iodide, barium iodide, or combinations thereof, and a rare-earth iodide selected from cerium iodide, dysprosium iodide, holmium iodide, thulium iodide, or combinations thereof;

wherein the molar ratio of sodium iodide to alkaline-earth iodide is from about 0.6 to about 11, the molar ratio of sodium iodide to rare-earth iodide is from about 0.5 to about 2.8, and the molar ratio of alkaline-earth iodide to rare-earth iodide is from about 0.1 to about 2.

15. The thallium-free metal halide fill of claim 14 wherein the fill further contains lithium iodide in an amount up to about 30 mole percent of the total metal iodide content.

16. The discharge lamp of claim 14 wherein the discharge vessel contains argon gas at a pressure from 30 torr to 300 torr.

17. The discharge lamp of claim 5 wherein the lamp when operated at its rated power exhibits a correlated color temperature within the range from about 4000 K to about 5000 K, a CRI greater than about 80, and an efficacy greater than about 80 LPW.

18. The discharge lamp of claim 14 wherein the lamp when operated at its rated power exhibits a correlated color temperature within the range from about 4000 K to about 5000 K, a CRI greater than about 80, and an efficacy greater than about 80 LPW.

* * * * *